US007001213B2

(12) United States Patent
Kaneko et al.

(10) Patent No.: US 7,001,213 B2
(45) Date of Patent: Feb. 21, 2006

(54) SHIELDED ELECTRICAL CONNECTOR

(75) Inventors: Tomonari Kaneko, Yamato (JP); Masami Yutani, Kanagawa (JP); Atsuhiro Horino, Kanagawa (JP); Kousuke Taketomi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/025,345

(22) Filed: Dec. 22, 2004

(65) Prior Publication Data

US 2005/0181661 A1 Aug. 18, 2005

(30) Foreign Application Priority Data

Dec. 22, 2003 (JP) ..... 2003-425261
Sep. 10, 2004 (JP) ..... 2004-263888

(51) Int. Cl.
*H01R 9/05* (2006.01)

(52) U.S. Cl. ..... 439/579; 439/610; 439/497

(58) Field of Classification Search ..... 439/579, 439/497, 607, 610, 427, 584
See application file for complete search history.

(56) References Cited

U.S. PATENT DOCUMENTS

| | | | | |
|---|---|---|---|---|
| 3,869,190 A | | 3/1975 | Bazille, Jr. | 339/98 |
| 4,406,512 A | * | 9/1983 | Schell | 439/497 |
| 5,330,367 A | | 7/1994 | Janczak | 439/402 |
| 5,964,620 A | | 10/1999 | Takahashi et al. | 439/579 |
| 5,975,955 A | | 11/1999 | Bogiel et al. | 439/607 |
| 6,056,597 A | * | 5/2000 | Shepherd et al. | 439/579 |
| 6,065,993 A | * | 5/2000 | Lai et al. | 439/402 |
| 6,065,998 A | | 5/2000 | Peloza et al. | 439/578 |
| 6,074,251 A | * | 6/2000 | Edgerly et al. | 439/610 |
| 6,080,006 A | | 6/2000 | Broder | 439/409 |
| 6,116,948 A | | 9/2000 | Kunishi | 439/495 |
| 6,273,753 B1 | * | 8/2001 | Ko | 439/579 |
| 6,273,758 B1 | | 8/2001 | Lloyd et al. | 439/607 |
| 6,338,652 B1 | | 1/2002 | Ko | 439/579 |
| 6,428,344 B1 | * | 8/2002 | Reed | 439/455 |
| 6,454,606 B1 | | 9/2002 | Igarashi | 439/610 |
| 6,551,129 B1 | | 4/2003 | Kato | 439/497 |
| 6,739,910 B1 | * | 5/2004 | Wu | 439/608 |

FOREIGN PATENT DOCUMENTS

| | | |
|---|---|---|
| JP | 11260439 | 9/1999 |
| JP | 11260440 | 9/1999 |

* cited by examiner

*Primary Examiner*—Hien Vu
(74) *Attorney, Agent, or Firm*—Stephen Z. Weiss

(57) ABSTRACT

A shielded electrical connector is provided for terminating a plurality of coaxial cables, each cable including an inner conductor surrounded by a dielectric cover and an outer conductive shield. The connector includes a dielectric housing having a mating end and a terminating end. A plurality of terminals are mounted on the housing and include mating portions located generally at the mating end of the housing and terminating portions terminated to the inner conductors of the cables. A conductive clamp is secured to the housing in clamping engagement with the conductive shields of the cables. A conductive shell is mounted over the housing in engagement with the conductive clamp to electrically couple the cable shields to the shell.

16 Claims, 7 Drawing Sheets

SHIELDED ELECTRICAL CONNECTOR

FIELD OF THE INVENTION

This invention generally relates to the art of electrical connectors and, particularly, to a shielded electrical connector for terminating a plurality of radio frequency cables.

BACKGROUND OF THE INVENTION

Radio frequency cables ("coaxial cables") are used for transmitting high frequency signals in such electrical applications as telephones, personal computers and the like in order to transmit a large volume of information. FIGS. 13 and 14 show a conventional coaxial cable, generally designated 16. The coaxial cable includes a signal line 18 which is comprised of a center or inner conductor 20 surrounded by an inner insulator or dielectric cover 22. An outer conductive shield 24 surrounds signal line 18 and consists of a plurality of braided wires. An outer insulator or covering 26 covers the outer conductive shield. In order to terminate coaxial cable 16, inner insulator 22 is stripped or cut-back to expose inner conductor 20, and outer insulator or covering 26 is stripped or cut back to expose outer conductive shield 24.

FIG. 15 shows how coaxial cable 16 might be connected to associated contacts 28*a* and 28*b*. Inner conductor 20 is connected by soldering 30*a* to contact 28*a*, and outer conductive shield 24 is connected to contact 28*b* by soldering 30*b*. The outer conductive shield typically is twisted into a strand, as shown, and then soldered to contact 28*b*.

Coaxial cables have diversified over the years, and it has become increasingly common to use a composite flat cable consisting of a plurality of coaxial cables 16 in a generally planar or flat array, for termination to a linear array of contacts in an associated connector. When the flat cable is connected to contacts by soldering methods as described above, the number of assembly steps increases as the number of coaxial cables increase. In addition, differences arise in the characteristics of the individual coaxial cables due to variations in the amount of soldering used for each cable, making it impossible to achieve uniform performance of all of the coaxial cables. Still further, despite the large number of coaxial cables used in flat composite cables, such electronic apparatus as mobile telephones and personal computers are being increasingly miniaturized. Therefore, there is a limit as to what can be achieved with conventional solder connection technology for establishing connections between the contacts of a connector and the multiple conductors of a flat composite coaxial cable.

FIG. 16 shows a prior art connector, generally designated 32, which is designed to alleviate some of the above problems. As shown, a plurality of coaxial cables 16 are arranged in a flat or linear array and include a plurality of individual inner conductors (not visible in the drawings) terminated to a plurality of contacts 34 of the connector. The conductive shields 24 of the coaxial cables are arranged in a side-by-side array and held between a pair of metal plates 36 to effect soldering. The metal plates serve as a common ground for the plurality of coaxial cables and are commonly called "ground bars".

Even with the technology of FIG. 16, it still is necessary to solder the conductive shields of coaxial cables 16 to ground bars 36. In addition, the conductive shields may disadvantagely harden when the solder material is drawn onto the braided wires of the shields when so-called solder wicking occurs. The resulting loss of flexibility of the braided wires causes a loss in flexibility of the coaxial cables which, in turn, detracts from the usability of the coaxial cables because routing of the coaxial cables becomes difficult or it becomes difficult to arrange the coaxial cables within a confined space in the interior of a portable electronic apparatus. Still further, cracking may develop in the solder connections if excessively large external forces are applied to the hardened areas of the braided wires. Recent portable devices, such as portable telephones, have achieved compactness by allowing users to fold the devices into halves. Therefore, if hardening occurs due to solder wicking, it becomes difficult to open and close the portable device at a hinge portion and contact failure can occur. The present invention is directed to solving the above myriad of problems.

Examples of the prior art are shown in Japanese patent documents JP 2000-260497 A, JP 11-260439 A and JP 11-260440 A.

SUMMARY OF THE INVENTION

An object, therefore, of the invention is to provide a new and improved shielded electrical connector of the character described, for terminating a plurality of radio frequency cables ("coaxial cables"), with each cable including at least an inner conductor surrounded by a dielectric cover and an outer conductive shield.

In the exemplary embodiment of the invention, the connector includes a dielectric housing having a mating end and a terminating end. A plurality of terminals are mounted on the housing and include mating portions located generally at the mating end of the housing and terminating portions terminated to the inner conductors of the cables. A conductive clamp is secured to the housing in clamping engagement with the conductive shields of the cables. A conductive shell is mounted over the housing in engagement with the conductive clamp to electrically couple the cable shields to the shell. Preferably, the conductive shell is configured for mating with an appropriate conductive shell of a mating connector.

According to one aspect of the invention, the conductive clamp has a first clamp portion for engaging the conductive shields of the cables and a second clamp portion for clamping onto the dielectric covers of the cables.

According to another aspect of the invention, the conductive clamp is generally U-shaped in cross-section to form first and second walls joined by a bight wall. The first and second walls define the first and second clamp portions, respectively, of the conductive clamp. The bight wall is disposed for engagement by the conductive shell which includes at least one inwardly extending tab for establishing positive contact with the bight wall.

In the preferred embodiment, the first wall of the generally U-shaped conductive clamp is generally comb-shaped to define recesses separated by projecting teeth. The recesses embrace the conductive shields of the cables, and the teeth project between the cables. The teeth have locking portions for securing the conductive clamp to the dielectric housing. Similarly, the second wall of the U-shaped clamp is generally comb-shaped to define recesses which embrace the dielectric covers of the cables, along with teeth projecting between the cables and locked to the dielectric housing. The teeth of the first and second walls are shown herein as being lockingly received in a plurality of locking apertures in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
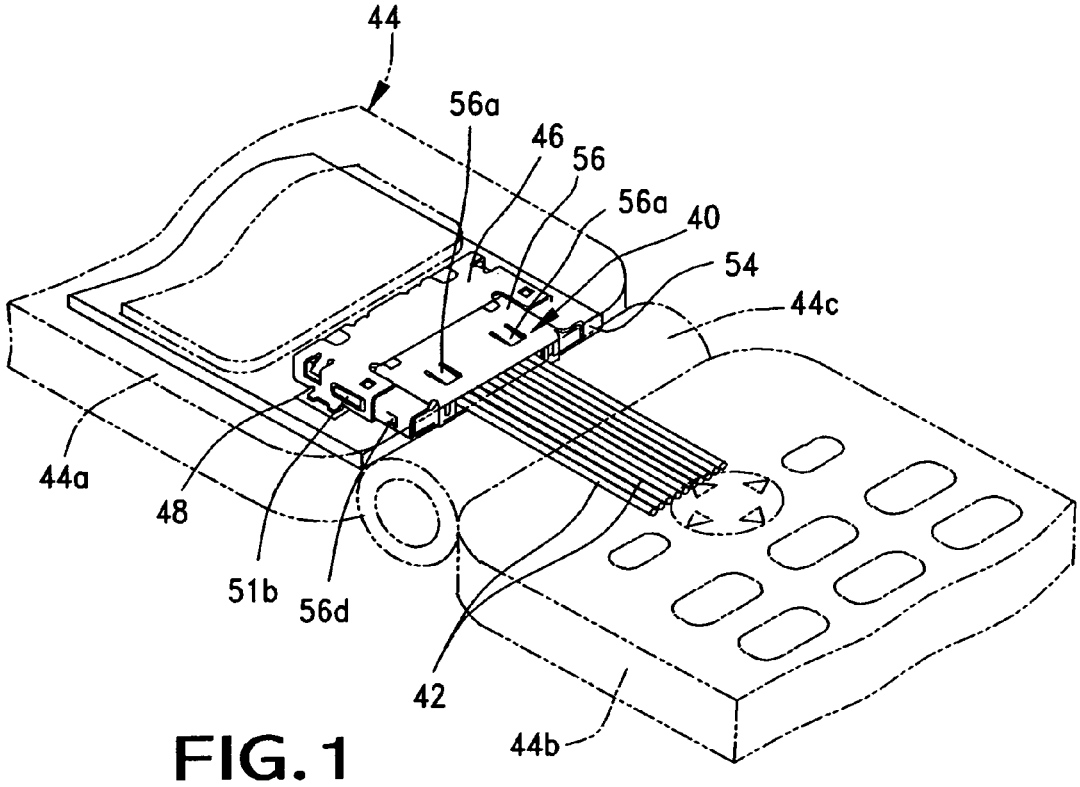
FIG. 1 is a perspective view of a portable telephone shown in phantom and incorporating a shielded electrical connector according to the invention, in conjunction with a mating connector on the telephone.

Referring to the drawings in greater detail, and first to FIG. 1, the invention is embodied in a shielded electrical connector, generally designated 40, for terminating a plurality of radio frequency cables ("coaxial cables") 42. The connector is shown in conjunction with a foldable portable telephone, generally designated 44 and shown in phantom. The shielded connector mates with a mating connector 46 which is mounted to a printed circuit board 48 on a liquid crystal screen side 44*a* of the telephone. An operation button side 44*b* of the portable telephone is connected to the liquid crystal screen side by a hinge 44*c*. Coaxial cables 42 are interconnected between mating connector 46 on the liquid crystal screen side 44*a* and a second mating connector (not shown) on the operation button side 44*b*. Although the shielded electrical connector 40 of the invention is shown in conjunction with a portable telephone herein, the connector is equally applicable for use in other applications such as personal computers and the like.

Figure 2:
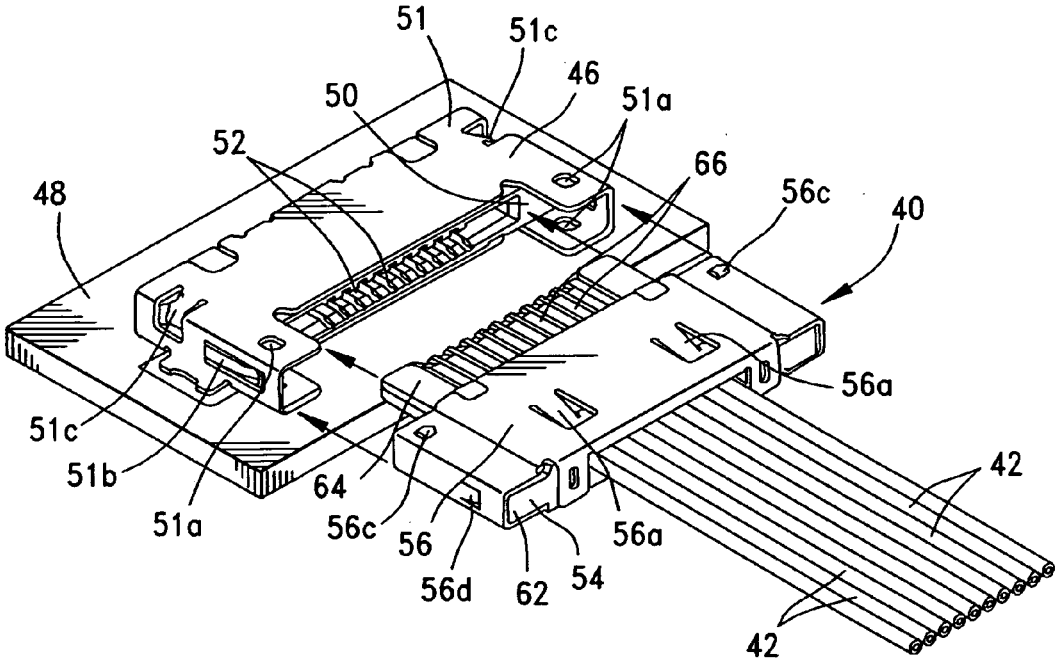
FIG. 2 is a perspective view of the shielded connector and mating connector isolated from the telephone, with the mating connector mounted on a printed circuit board.

Referring to FIG. 2 in conjunction with FIG. 1, mating connector 46 includes a dielectric housing 50 which serves as a base, a mating shell 51 soldered onto printed circuit board 48 and being a conductive flat hollow rectangular member covering the entirety of housing 50. Mating contacts 52 are mounted on the housing and mate with contacts of shielded connector 40 as described hereinafter. The mating shell includes a plurality of locking holes 51*a* in the top and bottom thereof, and a pair of elastic contact fingers 51*b* are stamped and formed in opposite sides thereof. Finally, mating shell 51 includes a pair of locking tabs 51*c* for elastically engaging housing 50 to prevent the mating shell from dislodging from the housing.

Figure 3:
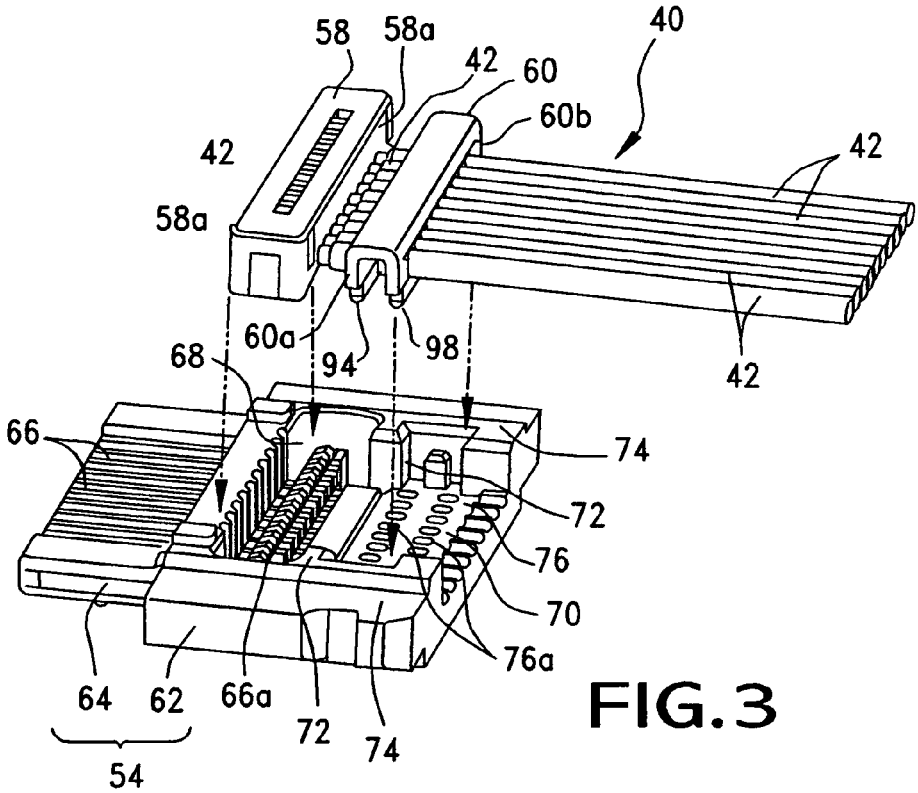
FIG. 3 is an exploded perspective view of various components of the shielded connector, with the conductive shell removed.
Figure 4:
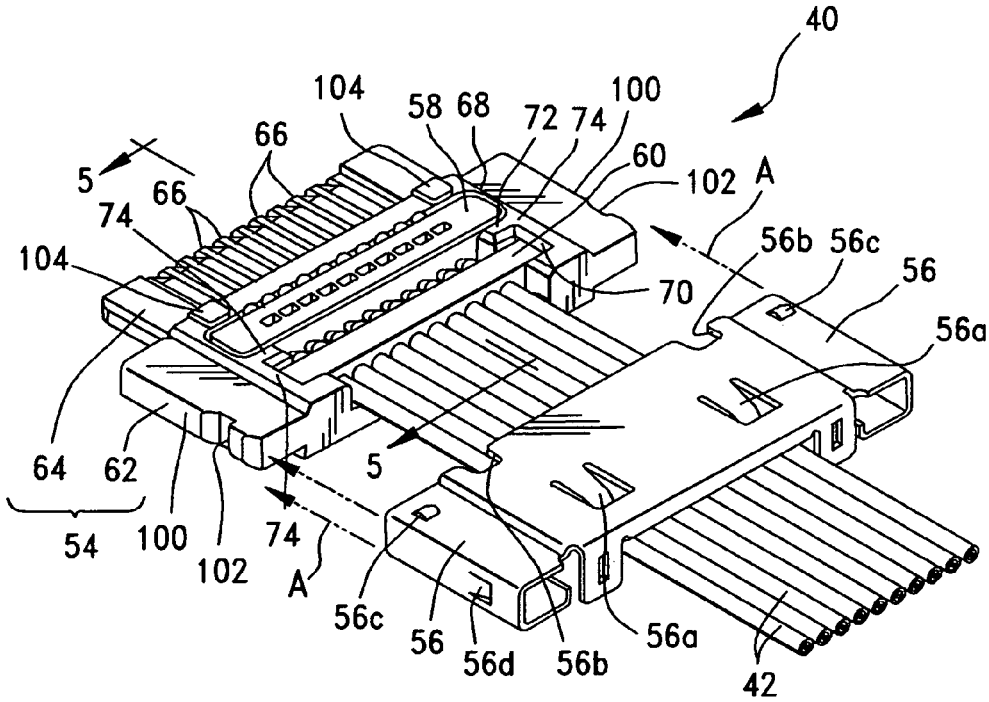
FIG. 4 is a perspective view of the components of FIG. 3 in assembled condition, and in conjunction with the conductive shell of the connector.

Referring to FIGS. 1–4, shielded electrical connector 40 of the invention includes an inner dielectric housing 54 and an outer conductive shell 56. As best seen in FIG. 4, the shell has an upper wall and right and left side walls which are bent in L-shaped configurations from the upper wall to define opposite sides of the shell which are generally U-shaped. A pair of inwardly bent tabs 56*a* are formed in the upper wall of the shell. A pair of cut-outs 56*b* are formed in a front edge of the shell. A pair of locking bosses 56*c* project upwardly from both the top and bottom of the shell (the bottom bosses not being visible in the drawings). Locking bosses 56*c* snap into locking engagement with locking holes 51*a* (FIG. 2) of mating shell 51 of mating connector 46 when the two connectors are mated. Finally, a pair of inwardly bent locking tabs 56*d* are provided at opposite sides of the shell for locking engagement with housing 54 as described hereinafter.

As best seen in FIGS. 3 and 4, shielded electrical connector 40 includes a pair of cable holders 58 and 60 for mounting onto housing 54. Cable holder 58 is an insulative holder, and cable holder 60 is a conductive holder and, hereinafter, will be referred to as a "conductive clamp".

Housing 54 is molded of plastic material and includes a main body portion or terminating end 62 and a forwardly projecting mating portion or end 64. A plurality of contacts 66 are mounted on mating portion 64 and have terminating portions 66*a* disposed within body portion 62.

Main body portion 62 of housing 64 includes a front recess 68 and a rear recess 70, both recesses opening at the top of the housing. A pair of vertical support columns 72 project inwardly from a pair of side walls 74 of the body portion and separate the front and rear recesses 68 and 70, respectively. It can be seen best in FIG. 3 that the front and rear recesses 68 and 70, respectively, are open in a front-to-rear direction and communicate with each other so that coaxial cables 42 can be positioned into body portion 62 of the connector. As seen in FIG. 3, the housing includes a rectangular metal plate 76 disposed in the bottom of rear recess 70. The plate has through holes 76*a*. The plate is fabricated of a metal material having good conductivity, such as copper or the like. The metal plate is securely fixed at the bottom of rear recess 70, such as overmolding the housing about the plate.

Figure 5:
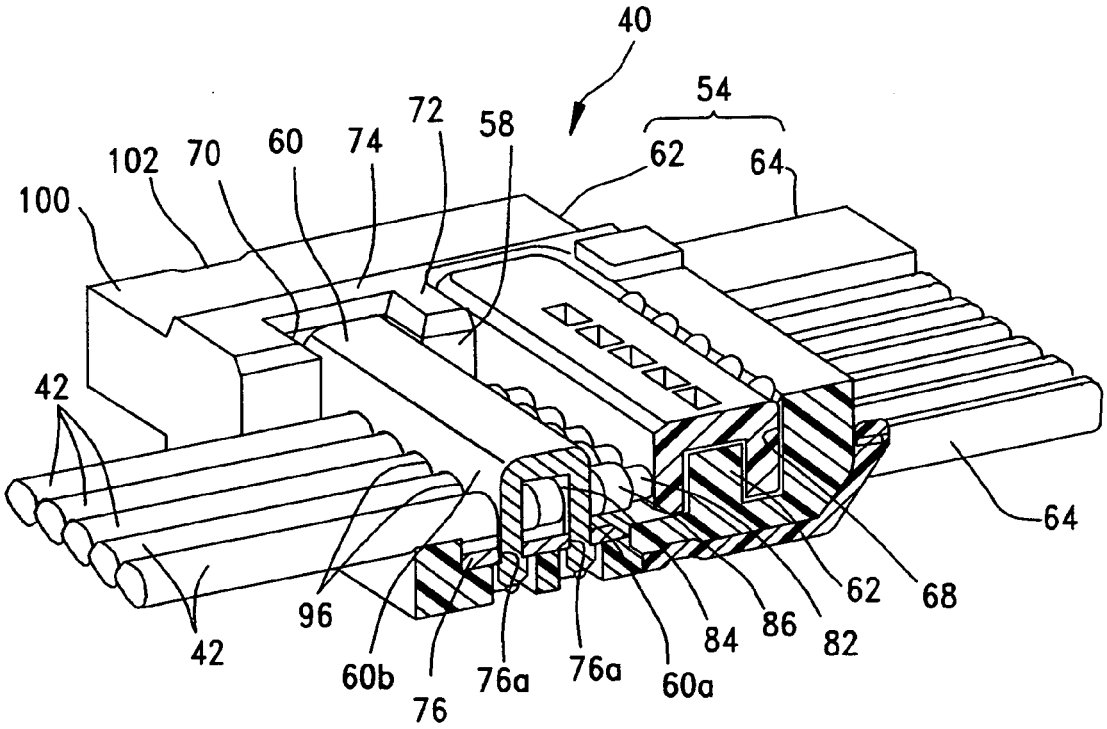
FIG. 5 is an enlarged vertical section taken generally along line 5—5 in FIG. 4.

Referring to FIG. 5 in conjunction with FIGS. 3 and 4, insulative cable holder 58 is positionable into front recess 68 of body portion 62 of housing 54. The insulative cable holder is elongated to span coaxial cables 42 and has an inverted, generally U-shaped configuration to define side walls 58*a* of the holder. Conductive clamp 60 is positionable into rear recess 70 of body portion 62 of housing 54. The conductive clamp also is elongated to span coaxial cables 42 and has an inverted, generally U-shaped configuration and includes opposite side walls 60*a* and 60*b*.

Figure 6:
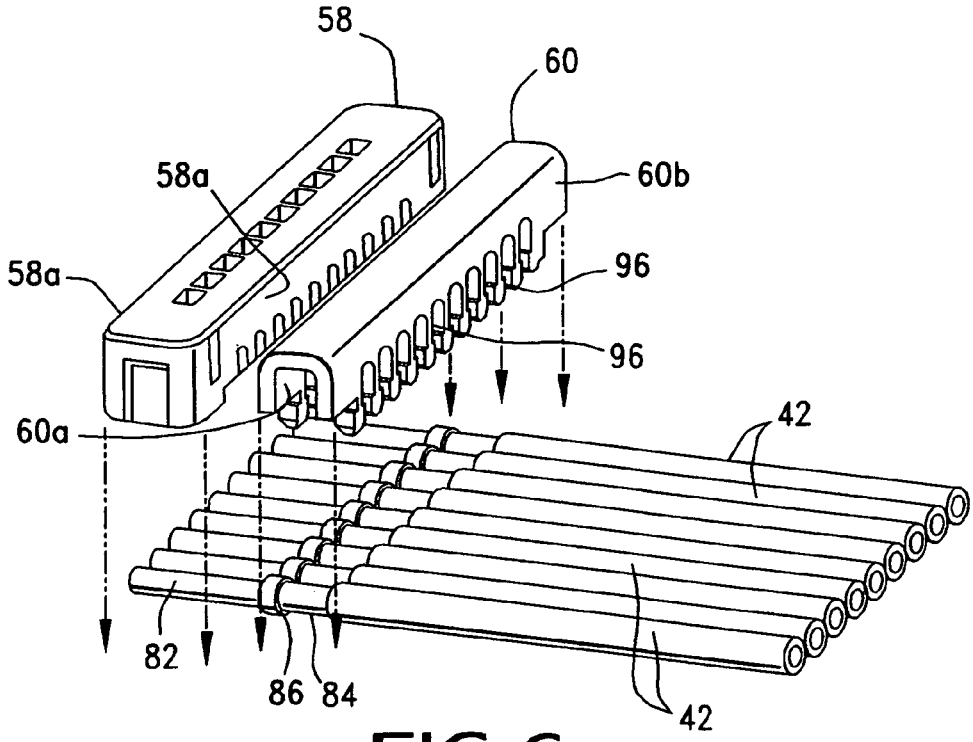
FIG. 6 is a perspective view of a flat array of coaxial cables as would be terminated in the connector, in conjunction with the cable holder and cable clamp of the connector.
Figure 7:
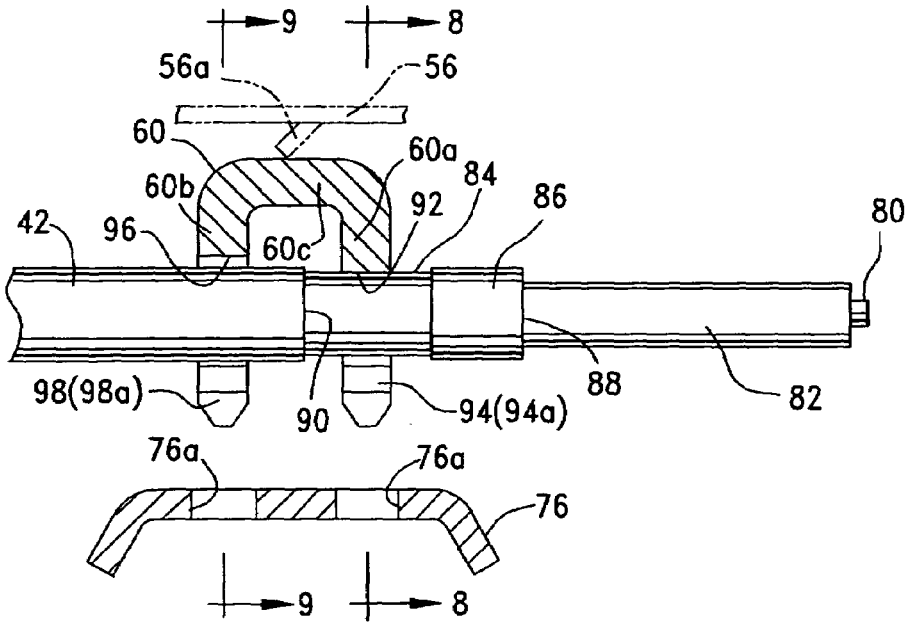
FIG. 7 shows a somewhat schematic illustration, partially in section and partially in phantom, of the relationship between the cable clamp, the conductive shell and one of the coaxial cables.

Before terminating coaxial cables 42 within shielded connector 40, the cables are prepared as shown in FIGS. 6 and 7. Specifically, each coaxial cable 42 includes an inner conductor 80 surrounded by an inner insulator or dielectric cover 82. The dielectric cover is surrounded by an outer conductive shield 84 which, in turn, is surrounded by an outer insulator or covering 86. The cable is prepared by stripping conductive shield 84 and outer insulator 86, as at 88 in FIG. 7, to expose a distal end of dielectric cover 82. The outer insulator 86 is cut-out, as at 90, to expose a longitudinal section of conductive shield 84 as best seen in FIG. 7.

As stated above, conductive clamp 60 has an inverted, generally U-shaped configuration to define opposite side walls 60*a* and 60*b*. As seen in FIG. 7, these side walls are joined by a bight wall 60*c*. When conductive shell 56 is mounted onto housing 54, inwardly bent tabs 56*a* of the shell engage bight wall 60*c* of the cable clamp as seen in FIG. 7.

Figure 8:
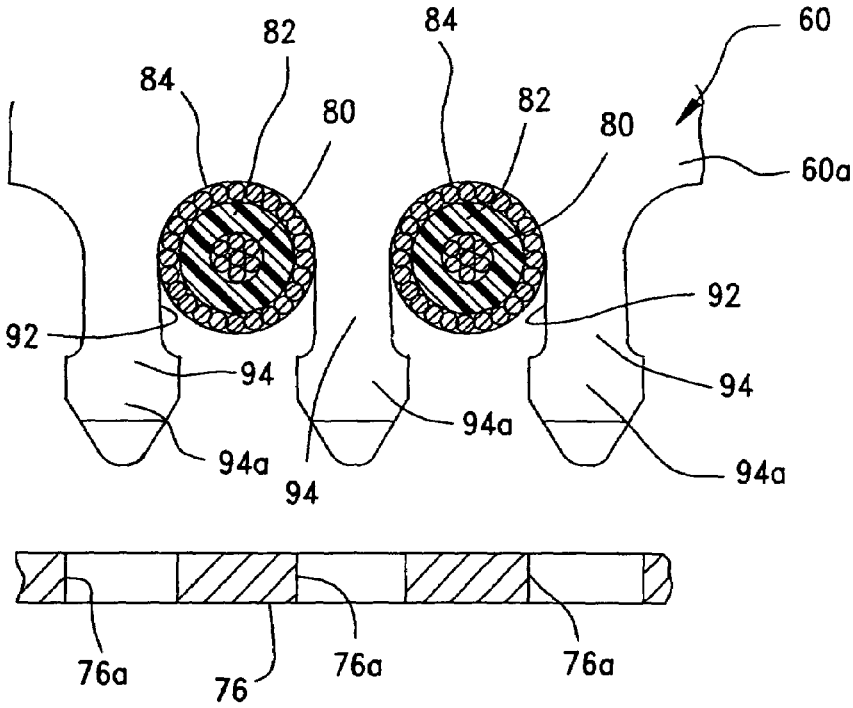
FIG. 8 is a vertical section taken generally along line 8—8 in FIG. 7.

Referring to FIG. 8 in conjunction with FIG. 7, side wall 60*a* of conductive cable clamp 60 is generally comb-shaped to define a plurality of recesses 92 separated by a plurality of projecting teeth 94. The teeth have enlarged distal ends 94*a*. During assembly, the coaxial cables are forced into recesses 92 and between teeth 94 in the area of conductive shield 84 as seen in FIG. 7 until the conductive shields of the cables fully seat in the recesses in full engagement with side wall 60*a* of conductive clamp 60 as seen in FIG. 8. It can be seen that teeth 94 are in alignment with through holes 76*a* in metal plate 76.

Figure 9:
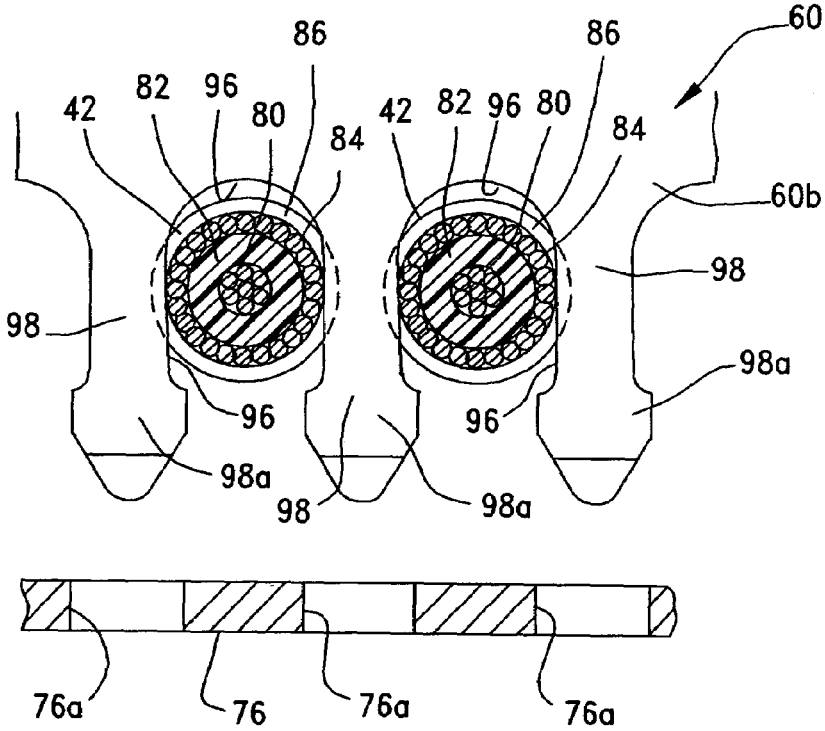
FIG. 9 is a vertical section taken generally along line 9—9 in FIG. 7.

Similarly, FIG. 9 shows that side wall 60*b* of conductive clamp 60 has a generally comb-shaped configuration to define a plurality of recesses 96 separated by a plurality of projecting teeth 98 having enlarged distal ends 98*a*. During assembly, the coaxial cables enter recesses 96 as seen in FIG. 9 in the area of outer insulators 86 as seen in FIG. 7. Teeth 98 align with through holes 76*a* in metal plate 76.

Figure 10:
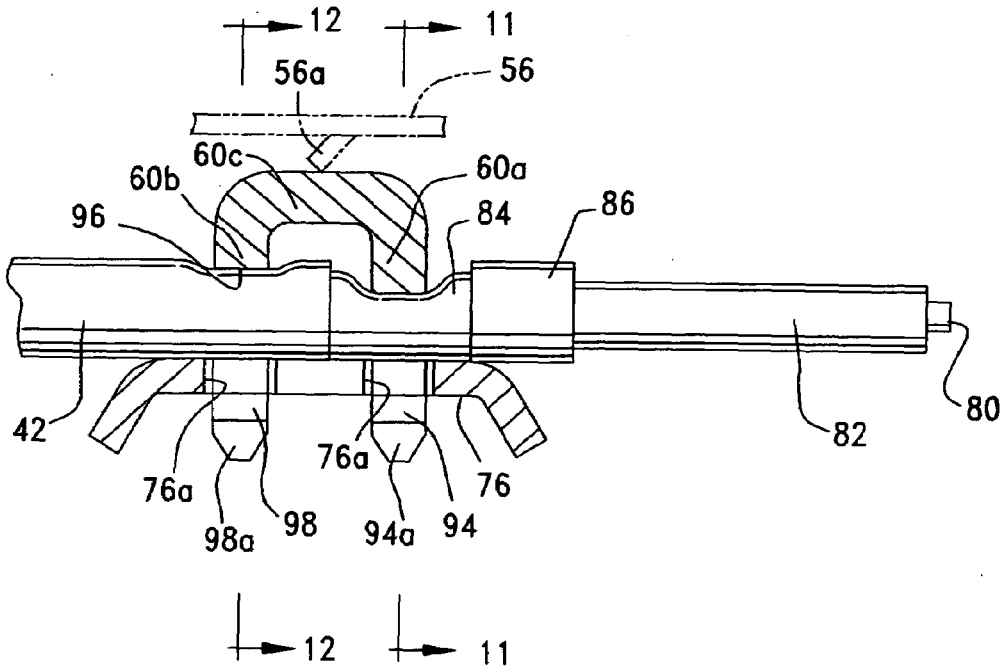
FIG. 10 is a view similar to that of FIG. 9, but showing the cable clamp clampingly engaging the coaxial cable.
Figure 11:
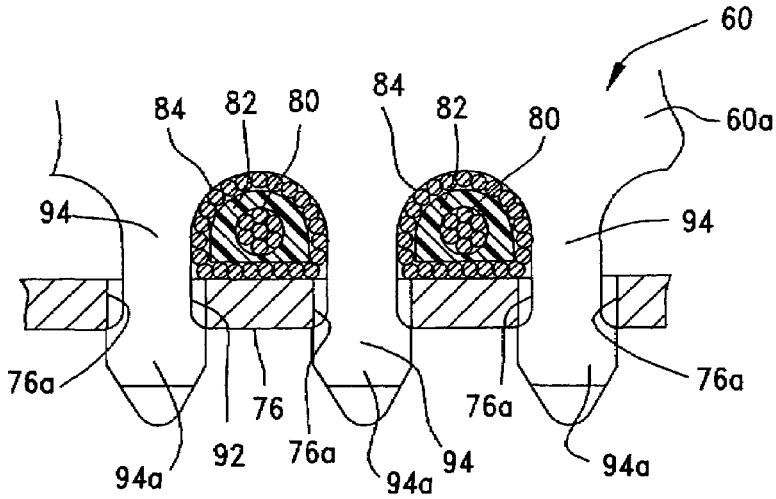
FIG. 11 is a vertical section taken generally along 11—11 in FIG. 10.

FIG. 10 is similar to FIG. 7, but shows conductive clamp 60 forced downwardly into clamping engagement with the coaxial cables 42. It can be seen that the conductive shields 84 of the cables are indented within recesses 92 and that the outer insulators 86 have been indented within recesses 96 to emphasize the clamping forces of cable clamp 60 onto the coaxial cables. To that end, enlarged distal ends 94*a* of teeth 94 of side walls 60*a* of conductive cable clamp 60, along with enlarged distal ends 98*a* of teeth 98 of side wall 60*b* of the cable clamp, are at least slightly larger than the through holes 76*a* in metal plate 76. This securely locks the conductive clamp to the highly conductive metal plate. With the conductive clamp securely clamping the conductive shields of the coaxial cables as seen in FIG. 11, there is a common conductivity running entirely through conductive clamp 60, metal plate 76 and conductive shields 84 of the coaxial cables. Then, this conductively commoned assembly conductively commoned two conductive shell 56 by the engagement of the inwardly bent tabs 56 of the shell with bight wall 60*c* of the conductive clamp.

Figure 12:
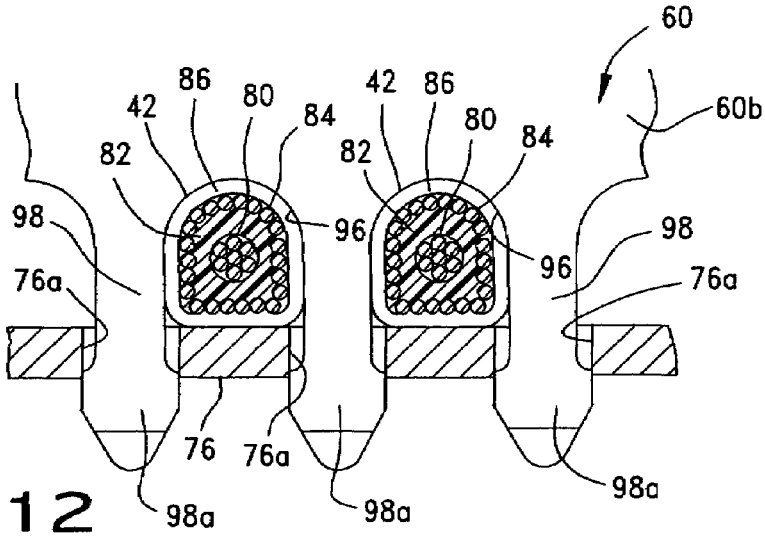
FIG. 12 is a vertical section taken generally along line 12—12 in FIG. 10.
Figure 13:
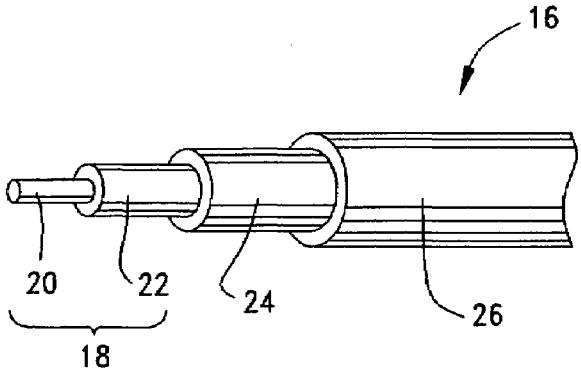
FIG. 13 (PRIOR ART)
FIGS. 13–16 are views of the prior art as described in the Background, above.
Figure 14:
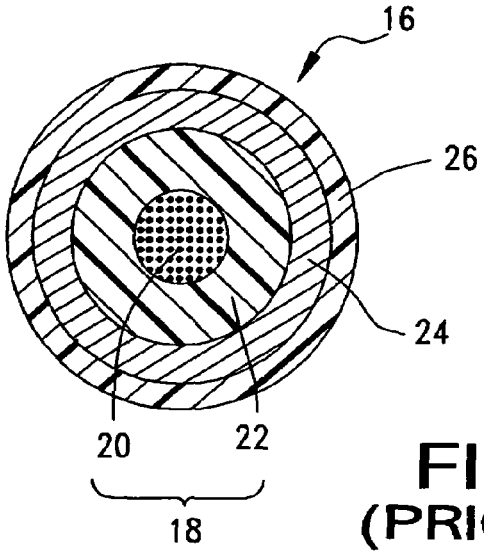
FIG. 14 (PRIOR ART)
Figure 15:
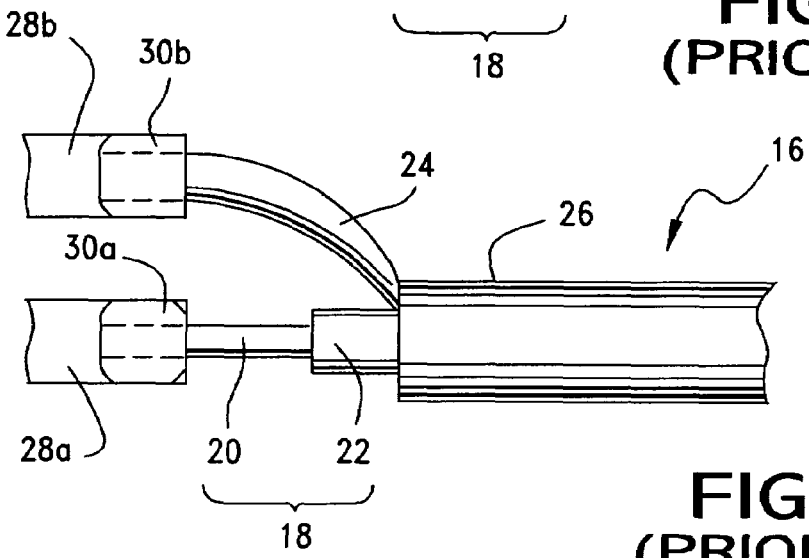
FIG. 15 (PRIOR ART)
Figure 16:
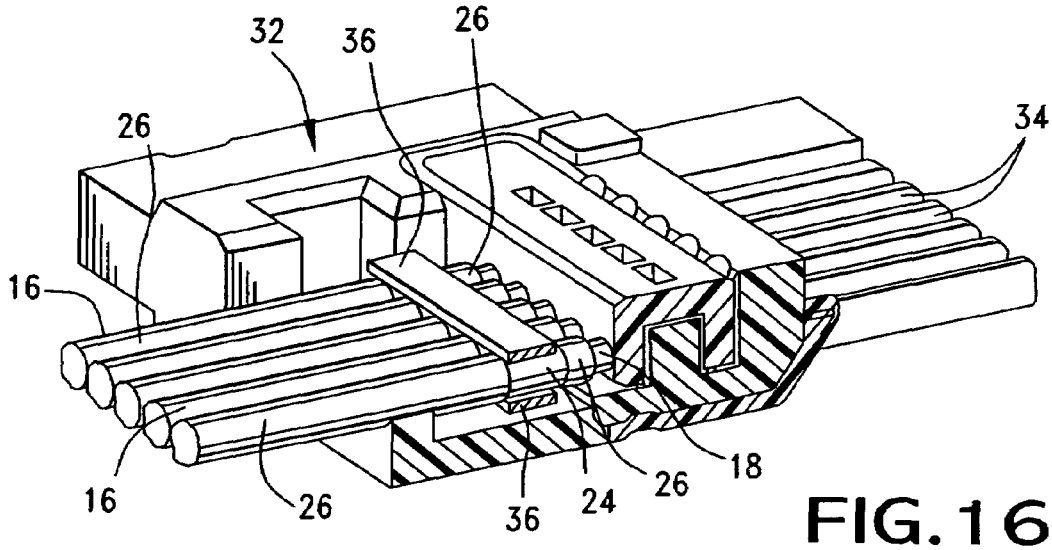
FIG. 16 (PRIOR ART)

Conductive clamp 60 also acts as a strain relief member for coaxial cables 42. This can be seen in FIG. 12 which shows the completely assembled or clamping position of the conductive clamp in relation to side wall 60*b* of the clamp. As described in relation to FIG. 9, recesses 96 embrace outer insulators 86 of the coaxial cables, and FIG. 12 shows how the clamping forces somewhat deform the cables as side wall 60*b* of the conductive clamp tightly clamps onto the outer insulators of the coaxial cables to provide strain relief therefor.

After coaxial cables 42 have been securely clamped within housing 54 by means of insulative cable holder 58 and conductive cable clamp 60 as shown in FIG. 5 and described above in relation to FIGS. 7–12, conductive shell 56 is assembled to housing 54 by sliding the shell onto the housing in the direction of arrows "A" in FIG. 4. The housing is formed with side wings 100 which have locking recesses 102. The housing also has a pair of upwardly projecting locking bosses 104. When the conductive shell is fully mounted onto the housing as shown in FIGS. 1 and 2, locking tabs 56*d* of the shell snap into locking engagement with locking recesses 102 on the housing, and cut-outs 56*b* of the shell embrace bosses 104 of the housing. When connector 40 is mated with mating connector 46 as shown in FIG. 1, locking bosses 56*c* of the shell snap into engagement with locking holes 51*a* of mating shell 51 of mating connector 46.

Finally, it should be understood that insulative cable holder 58 can be used to terminate coaxial cables 42 to contacts 66. Specifically, terminating portions 66*a* (FIG. 3) of contacts 66 can be insulation displacement terminating portions. Therefore, insulative cable holder 58 is effective to drive the distal ends of the coaxial cables into the insulation displacement portions of the terminals which will cut through dielectric covers 32 of the cables and into engagement with inner conductors 80 of the cables.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector for terminating a plurality of radio frequency cables, each cable including an inner conductor surrounded by a dielectric cover and an outer conductive shield, comprising:

a dielectric housing having a mating end and a terminating end;

a plurality of terminals mounted on the housing and including mating portions located generally at the mating end of the housing and terminating portions terminated to the inner conductors of the cables;

a conductive clamp secured to the housing in clamping engagement with the conductive shields of the cables and having a comb-shaped wall defining recesses separated by projecting teeth, with the recesses embracing the conductive shields of the cables and the teeth projecting between the cables and the teeth having locking portions at distal ends thereon for securing the conductive clamp to the dielectric housing; and a conductive shell mounted over the housing in engagement with the conductive clamp to electrically couple the cable shields to the shell.

2. The shielded electrical connector of claim 1 wherein said conductive shell is configured for mating with an appropriate conductive shell of a mating connector.

3. The shielded electrical connector of claim 1 wherein said conductive clamp has a first clamp portion for engaging the conductive shields of the cables and a second clamp portion for clamping onto the dielectric covers of the cables.

4. The shielded electrical connector of claim 3 wherein said conductive clamp is generally U-shaped in cross-section to form first and second walls joined by a bight wall, the first and second walls defining said first and second clamp portions, respectively.

5. The shielded electrical connector of claim 4 wherein said bight wall of the conductive clamp is disposed for engagement by the conductive shell.

6. The shielded electrical connector of claim 5 wherein said conductive shell includes at least one inwardly extending tab for establishing positive contact with the bight wall of the conductive clamp.

7. The shielded electrical connector of claim 4 wherein said first wall is generally comb-shaped to define a plurality of first wall recesses separated by projecting first wall teeth, with the first wall recesses embracing the conductive shields of the cables and the first wall teeth projecting between the cables.

8. The shielded electrical connector of claim 7 wherein said first wall teeth have locking portions for securing the conductive clamp to the dielectric housing.

9. The shielded electrical connector of claim 4 wherein said second wall is generally comb-shaped to define a plurality of second wall recesses separated by projecting second wall teeth, with the second wall recesses embracing the dielectric covers of the cables and the second wall teeth projecting between the cables.

10. The shielded electrical connector of claim 9 wherein said second wall teeth have locking portions for securing the conductive clamp to the dielectric housing.

11. The shielded electrical connector of claim 1 wherein said conductive clamp includes a plurality of locking fingers projecting between the cables into locking engagement with the housing.

12. A shielded electrical connector for terminating a plurality of radio frequency cables, each cable including an inner conductor surrounded by a dielectric cover and an outer conductive shield, comprising:

a dielectric housing having a mating end and a terminating end;

a plurality of terminals mounted on the housing and including mating portions located generally at the mating end of the housing and terminating portions terminated to the inner conductors of the cables;

a conductive clamp secured to the housing and having a generally U-shaped configuration in cross-section to form first and second walls joined by a bight wall, the first wall being generally comb-shaped to define a plurality of recesses separated by projecting first wall teeth, said first wall teeth having locking portions at distal ends thereon for securing the conductive clamp to the dielectric housing, with the recesses embracing the conductive shields of the cables and the first wall teeth projecting between the cables, the second wall being generally comb-shaped to define a plurality of recesses separated by projecting second wall teeth, with the recesses of the second wall embracing the dielectric covers of the cables and the second wall teeth projecting between the cables; and a conductive shell mounted over the housing in engagement with the bight wall of the conductive clamp to electrically couple the cable shields to the shell.

13. The shielded electrical connector of claim 12 wherein said conductive shell is configured for mating with an appropriate conductive shell of a mating connector.

14. The shielded electrical connector of claim 12 wherein said conductive shell includes at least one inwardly extending tab for establishing positive contact with the bight wall of the conductive clamp.

15. The shielded electrical connector of claim 12 wherein said second wall teeth wall have locking portions for securing the conductive clamp to the dielectric housing.

16. A shielded electrical connector for terminating a plurality of radio frequency cables, each cable including an inner conductor surrounded by a dielectric cover and an outer conductive shield, comprising:

a dielectric housing having a mating end and a terminating end;

a plurality of terminals mounted on the housing and including mating portions located generally at the mating end of the housing and terminating portions terminated to the inner conductors of the cables;

a conductive clamp secured to the housing in clamping engagement with the conductive shields of the cables, said clamp including a plurality of locking fingers projecting between the cables, with the distal ends of the locking fingers each having an enlarged portion in locking engagement with a plurality of locking apertures in the housing; and a conductive shell mounted over the housing in engagement with the conductive clamp to electrically couple the cable shields to the shell.

* * * * *